US005163493A

United States Patent [19]

Kraeutler

[11] Patent Number: 5,163,493

[45] Date of Patent: Nov. 17, 1992

[54] GOODS-HANDLING DOOR MADE UP OF RIGID PANELS

[75] Inventor: Bernard Kraeutler, Dunieres, France

[73] Assignee: Nergeco (Societe Anonyme), Dunieres, France

[21] Appl. No.: 734,751

[22] Filed: Jul. 23, 1991

[30] Foreign Application Priority Data

Jul. 27, 1990 [FR] France ..... 90 09599

[51] Int. Cl.[5] ..... E05D 15/06

[52] U.S. Cl. ..... 160/201; 160/236; 16/272

[58] Field of Search ..... 160/201, 236, 133, 381; 16/271, 272

[56] References Cited

U.S. PATENT DOCUMENTS 2,311,470 2/1943 Ritter ..... 160/201 X
2,411,902 12/1946 Skelly ..... 160/201
2,926,729 3/1960 Zanini ..... 160/236
2,951,533 9/1960 Lucas et al. ..... 160/201 X
4,567,931 2/1986 Wentzel ..... 160/236 X
4,793,397 12/1988 Whiteman ..... 160/201
4,860,813 8/1989 Ballyns et al. ..... 160/201 X

*Primary Examiner*—Blair M. Johnson
*Attorney, Agent, or Firm*—Iandiorio & Dingman

[57] ABSTRACT

A goods-handling door constituted by rigid panels connected to reinforcing bars, at least some of which extend into slideways, wherein each panel is constituted by two parallel rails disposed in the vicinity of its longitudinally-extending sides, each rail having fixing means on two opposite longitudinal edges thereof enabling it to be fixed on one edge to connection means for connection with a reinforcing bar and on the opposite edge to at least two spacers for interconnecting the two rails of the panel, with the area between the rails being filled by rigid filler plates.

5 Claims, 5 Drawing Sheets

FIG.9
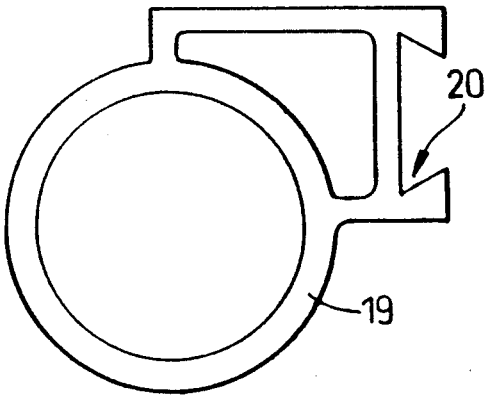
FIG.8
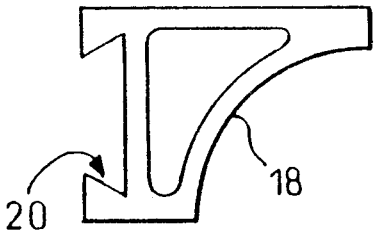
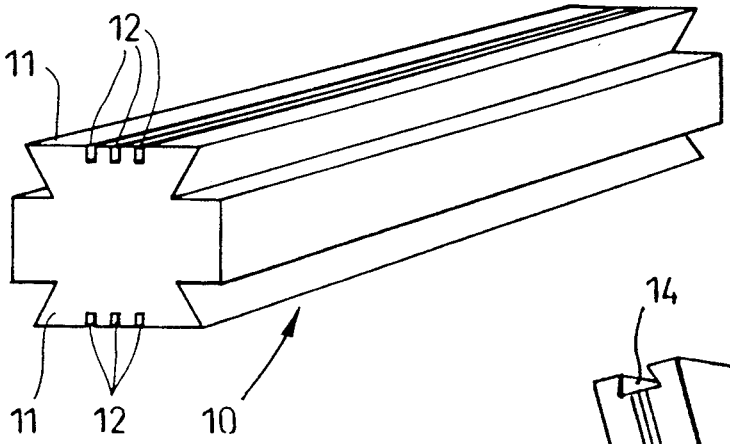
FIG.6
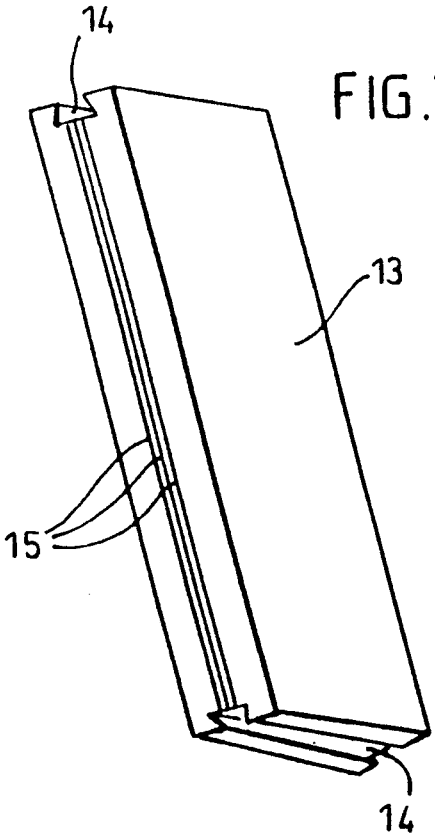
FIG.7
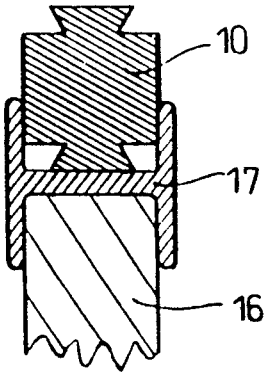
FIG.10

GOODS-HANDLING DOOR MADE UP OF RIGID PANELS

The present invention relates to a goods-handling door made up of panels capable of being folded, wound, stacked, or juxtaposed to leave room for the passage of vehicles or other equipment, in factories, hangars, warehouses, and other industrial buildings, or to close garages, or to constitute protective curtains for shops or the like. More particularly, the invention relates to a panel structure making it possible to implement panels of any size quickly and simply from a few simple standard components.

BACKGROUND OF THE INVENTION

FIGS. 1 and 2 of the accompanying drawings show an example of a goods-handling door to which the invention may be applied. This door comprises two vertical lateral uprights 1 and 2 interconnected at their top ends by a horizontal cross-bar 3. The uprights are generally channel section, each including a vertical slideway 4. The uprights and the cross-bar are intended to be placed around a door bay so as to enable the door to open and close the bay. Advantageously, the area left free between the uprights and beneath the cross-bar corresponds to the area of the door bay, with the uprights and the cross-bar being placed against the wall surrounding the door bay.

The closure surface of the door is constituted by panels 5 that are hinged together in pairs by horizontal hinges with hinge pins passing therethrough. The hinge pins also constitute reinforcing bars 6, 7, with every other reinforcing bar extending into the slideways, beginning with the bottom bar 7A. The length of the panels is substantially equal to or slightly less than the width of the door, i.e. the available gap between the uprights 1 and 2, thereby making it possible to fold up the panels between the uprights. The door is opened by raising the bottom bar 7A whose ends extend into the slideways for guidance purposes. The bottom bar may be raised by straps which are fixed to the bottom bar and which are wound onto a wind-up shaft preferably housed inside the top cross-bar.

By winding up the straps, the bar 7A is raised, thereby folding the bottom two panels 5A and 5B against each other with the hinge bar 6A interconnecting them moving out away from the plane of the door (given that the bar 6A is of such a length as to ensure that its ends to not penetrate into the slideways 4 of the uprights). Thereafter, the bottom bar 7A comes into abutment against the next bar up 7B that does have its ends engaged in the slideways of the uprights and begins to raise it, and so on until all of the panels are folded up against one another at the top of the door, as shown in FIG. 2.

The invention applies in general to other types of goods-handling doors made up of panels that need not necessarily be hinged to one another, e.g. to doors as shown in FIGS. 3 and 4 of the drawings.

In FIG. 3, the door is provided with vertical lateral uprights 1 and 2 each including a slideway, with the slideways of said uprights 1 and 2 extending upwards in the form of sloping or horizontal slideways given respective references 8 and 9. The door is provided with panels 5 that are hinged together about reinforcing bars 7 all of which extend into the slideway. To open the door, the top panel 5C is pulled upwards, thereby pulling the others along the slideways 8 and 9.

In FIG. 4, the door is provided with two vertical lateral uprights 1 and 2 each including a slideway 4 having panels 5 that slide therein but that are not hinged to one another. When the door is opened, the panels 5 are stacked together above the door.

In addition, application of the invention is not limited to doors that are raised vertically: the panels may slide horizontally towards a side of the door.

SUMMARY OF THE INVENTION

The present invention provides a goods-handling door constituted by rigid panels connected to reinforcing bars, at least some of which extend into slideways, wherein each panel is constituted by two parallel rails disposed in the vicinity of its longitudinally-extending sides, each rail having fixing means on two opposite longitudinal edges thereof enabling it to be fixed on one edge to connection means for connection with a reinforcing bar and on the opposite edge to at least two spacers for interconnecting the two rails of the panel, with the area between the rails being filled by rigid filler plates. Said connection means for connection to a reinforcing bar may be constituted by hinge means.

The rails may be made of metal, e.g. aluminum, of wood, of plastic, or of any other material. They are available in long lengths so that by cutting them up panels of all sorts of lengths can be built up very quickly. Thus, the manufacturer of a door of the invention can limit stock to a small number of different components, namely: a single type of rail, a single type of spacer (if all panels have the same width which is generally the case), one or more types of filler plate (e.g. transparent plates and opaque plates), and hinge means for fixing to the rails. Consequently, stock management becomes very simple and it becomes easier to minimize stocks. In addition, the simplicity with which the panels can initially be assembled, which is in itself advantageous, also has the effect of reducing the time and cost of initial assembly.

Finally, this structure is also highly advantageous when it comes to maintaining panels. The user of a door can thus build up a stock of spare parts comprising the various component parts of the panels and can therefore repair damaged panels quickly and easily, e.g. in the event of a collision with a vehicle.

Advantageously, the fixing means of the rails are interfitting means and the ends of the spacers and the connection means for connection to the reinforcing bars have complementary interfitting means enabling them to be assembled on the rails. In particular embodiment of the invention, said interfitting means of the rails are dovetail projections, and said complementary interfitting means of the spacers and of the connection means for connection with the reinforcing bars are dovetail slots.

The invention also provides such a door, wherein the rails, the spacers, and the connection means for connection with the reinforcing bars are stiff enough to withstand break-ins and the wind, but flexible enough to enable the engagement means to pop apart, thereby breaking up a panel in the event of a goods-handling vehicle colliding violently with a panel.

The invention also provides such a door, wherein the fixing means between the rails and the spacers, and the fixing means between the rails and the connection means for connection with the reinforcing bars are strong enough to withstand the wind and break-ins, but are weak enough to enable a panel to be broken up by at least some of said fixing means breaking in the event of a violent collision of a goods-handling vehicle and said panel.

Thus, in either case, in the event of a vehicle colliding violently with a panel, damage is limited to that panel, and possibly also the adjacent edges of the panels next to it. As a result, damage can be repaired more easily and more quickly.

In a particular embodiment of the invention, each rail includes at least one longitudinal groove on at least one of its two longitudinal edges that are provided with said fixing means, said groove serving to receive a filler plate. Further, each spacer may include at least one longitudinal groove disposed in the plane of the panel and serving to receive a filler plate for said panel. Thus, the filler plates can be assembled simply by sliding them along facing grooves in the rails and/or the spacers.

BRIEF DESCRIPTION OF THE DRAWINGS

Embodiments of the invention are described by way of example with reference to the accompanying drawings, in which:

FIG. 6 is a perspective view of a rail type panel component in accordance with the present invention;

FIG. 7 is a perspective view of a spacer type panel component in accordance with the present invention;

FIGS. 8 and 9 are sections through example hinge components; and

FIG. 10 is a section view showing how filler plates can be fixed between the rails by means of a flexible strip.

DETAILED DESCRIPTION

Figure 1:
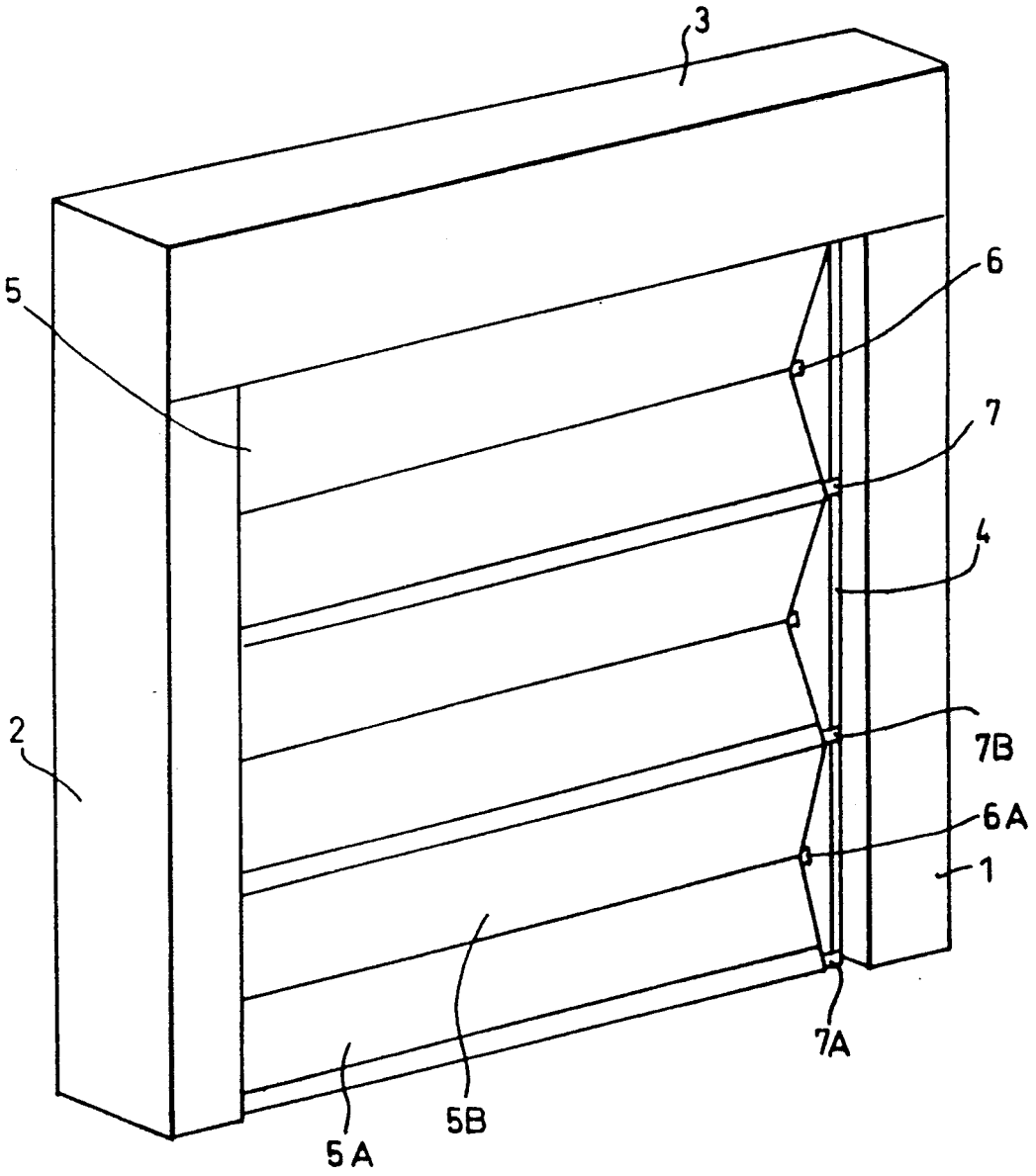
FIG. 1 is a perspective view of one type of door of the kind to which the invention can be applied.
Figure 2:
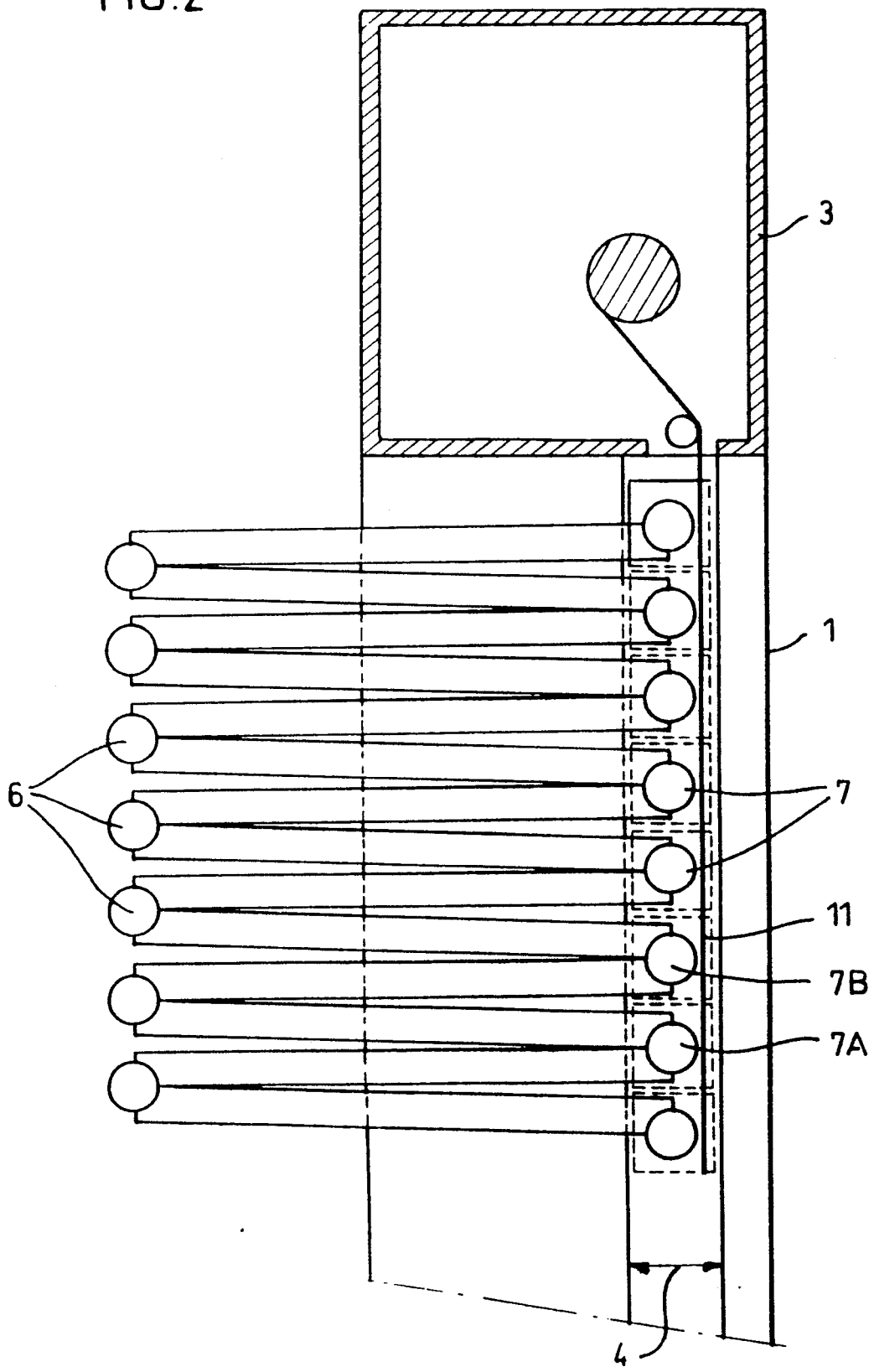
FIG. 2 is a detailed section view through the door of FIG. 1.
Figure 3:
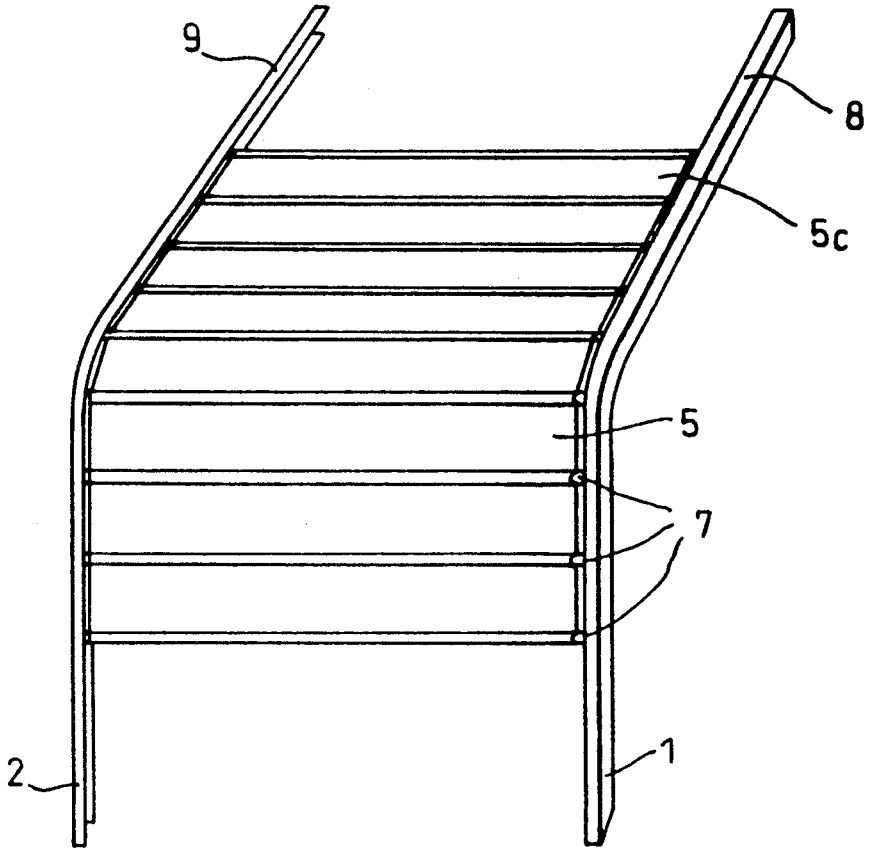
FIG. 3 is a diagrammatic perspective view of another type of door to which the invention can be applied.
Figure 5:
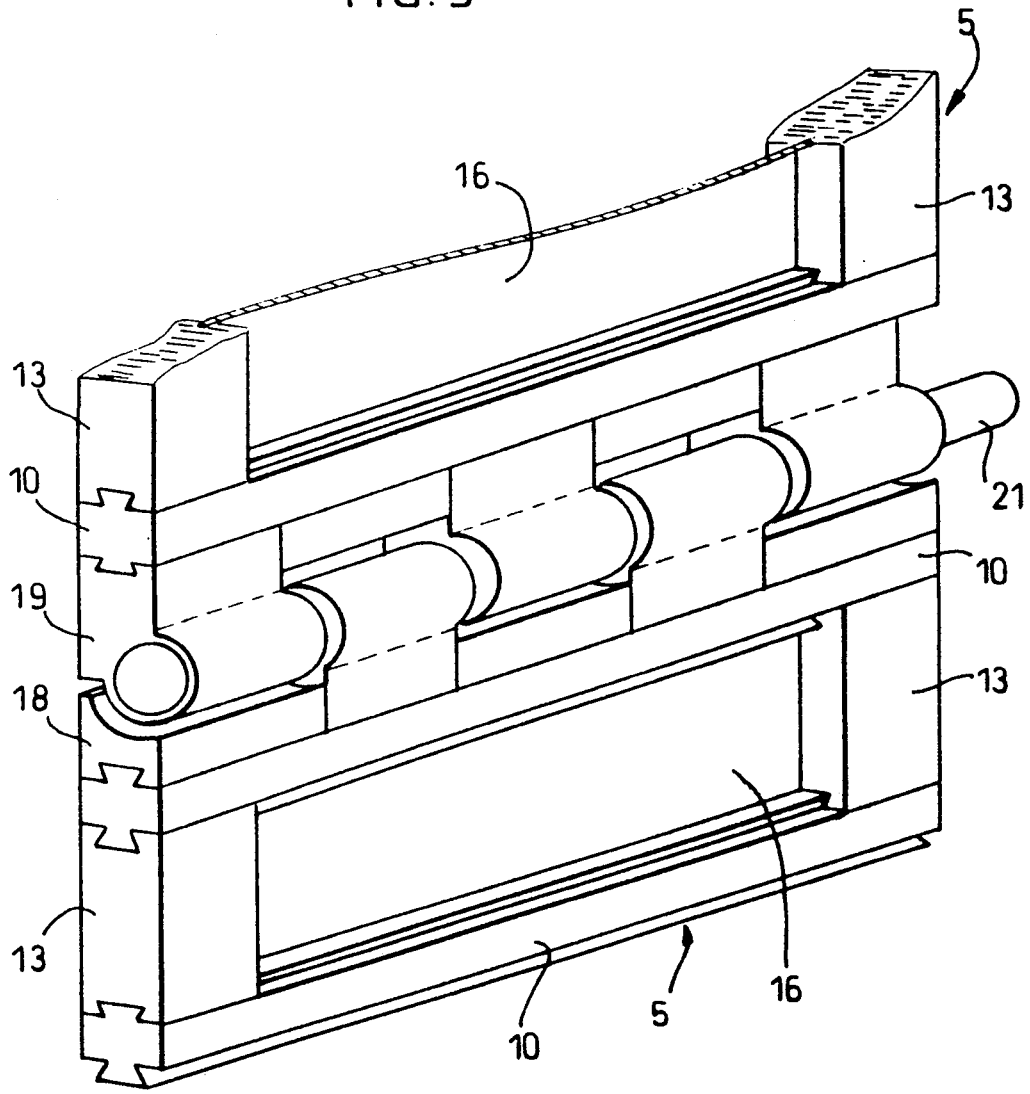
FIG. 5 is a fragmentary perspective view of one embodiment of the invention.

FIG. 5 shows panels 5 more specifically intended for use in a goods-handling door as shown in FIGS. 1 and 2, or as shown in FIG. 3.

Each of the panels 5 comprises two parallel rails 10 shown in greater detail in FIG. 6. Each rail 10 has fixing means along two opposite longitudinal edges, and constituted in this case by dovetail projections 11. In the particular example of FIG. 6, the rails 10 also include one or more longitudinal grooves 12 in their dovetail longitudinal edges, for a purpose described below.

The two rails 10 in each panel 5 are interconnected by at least two spacers 13 such as the spacer shown in FIG. 7. Each spacer 13 extends between two ends each provided with a dovetail slot 14 to receive the dovetail projection 11 on a rail 10. In addition, in the particular example shown in FIG. 7, the spacer 13 includes one or more longitudinal grooves 15 on two opposite sides and in correspondence with the longitudinal grooves 12 of the rails 10.

The rails 10 and the spacers 13 form a frame and the openings in the frame can be filled with rigid plane filler plates 16 which may be made of plastic, of wood, e.g. plywood, of glass, of metal, etc. The filler plates 16 may be slid along the grooves 12 and 15 in the rails and the spacers. In a variant, a filler plate 16 may be fixed by means of a generally I-section flexible peripheral strip 17, as shown in FIG. 10. The strip 17 is initially fitted over the sides of the rails 10 and the spacers 13, and it then receives the filler plate 16 in conventional manner.

In addition, the face of the rail 10 facing away from the spacers 13 receives hinge components 18 and 19 as shown in detail and in section in FIGS. 8 and 9. Each hinge component 18 and 19 includes a dovetail slot 20 enabling it to be fixed on the dovetail projections 11 of the rails 10, on the sides of the rails facing towards the outside of the panel 5. As shown in FIG. 5, the hinge components 18 and 19 alternate along each rail 10 with each component 18 on one panel 5 facing a component 19 of an adjacent panel. In the particular example of FIG. 5, the panels 5 are hinged in pairs on reinforcing bars 21, at least some of which slide in fixed lateral slideways, as explained above with reference to FIGS. 1 to 3. The components 19 have the bars 21 threaded therethrough, whereas the components 18 serve to occupy the gaps between the panel 5 on which they are fixed and the facing components 19.

Figure 4:
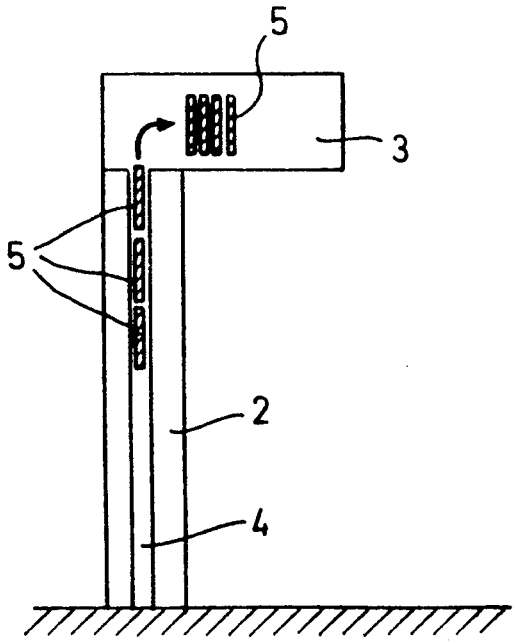
FIG. 4 is a diagrammatic vertical section through another type of door to which the invention can be applied.

When the panels 5 are not hinged in pairs, as shown in FIG. 4 by way of example, each panel 5 may be fixed to two reinforcing bars 21 by means of hinge components 19 only with the bars passing therethrough, or by any other fixing means.

In any event, it is advantageous for the ends of the reinforcing bars 21 that slide in the fixed slideways of the door to be capable of breaking in the event of a goods-handling vehicle striking the panel, without also breaking or permanently deforming any other parts. This makes it possible for the panel to move out of the way without excessive damage. For example, the reinforcing bars 21 may have a weak section between the edge of the panel and the slideway. In a variant, the bars may be sufficiently flexible to pop out from the slideways under the effect of an abnormal thrust without suffering permanent deformation.

The rails 10, the spacers 13 and the hinge components 18 and 19 may be made of plastic, e.g. by extrusion or by molding. They may also be made of wood, of metal, e.g. aluminum, etc. They are a friction fit and they may additionally be glued or welded together.

In an advantageous embodiment of the invention, the dovetail projections 11 on the rails 10 are small enough in section to break in the event of a violent shock, e.g. should a goods-handling vehicle catch onto one of the panels 5. As a result, the panel involved breaks up but the other panels are not subjected to a force that might damage them. Possibly only the adjacent edges of the neighboring panels run the risk of being damaged. Naturally, the cross-section of the dovetail projections 11 must nevertheless be large enough to ensure that the panel 5 can withstand bad weather (wind) and attempts at breaking in.

In another advantageous embodiment of the invention, the rails 10, the spacers 13, and the hinge components 18 and 19 are held together by friction only, without gluing and without welding, and they are flexible enough to enable the dovetail projections 11 to pop out from the dovetail slots 14 and 20 in the event of a violent shock on the panel 5, e.g. due to a goods-handling vehicle. As a result, the panel concerned breaks up, thereby limiting damage to that panel and possibly to the adjacent edges of the neighboring panels. As before, it must not be too easy to cause the pieces to pop apart since the panels must be capable of withstanding bad weather (wind) and attempts at breaking in.

I claim:

1. A goods-handling door constituted by rigid rectangular panels having horizontal and vertical sides connected to reinforcing horizontal bars, at least some of which extend into slideways, wherein each panel is constituted by two parallel rails disposed in the vicinity of its horizontal sides, each rail having interfitting fixing means on two opposite horizontal edges thereof for being fixed on one edge to hinge means for connection with said reinforcing bar and on the opposite edge to at least two spacers, said interfitting fixing means being identical ends of the spacers being formed with complementary interfitting means for interconnecting the two rails of the panel, with the area between the rails being filled by rigid filler plates.

2. A goods-handling door according to claim 1, wherein said interfitting means of the rails are dovetail projections, and said complementary interfitting means of the spacers and of the connection means for connection with the reinforcing bars are dovetail slots.

3. A goods-handling door according to claim 1, wherein the rails, the spacers, and the hinge means for connection with the reinforcing bars are stiff enough to withstand break-ins and the wind, but flexible enough for the interfitting means to pop apart, in the event of a goods-handling vehicle colliding violently with a panel.

4. A goods-handling door according to claim 1, wherein each rail includes at least one longitudinal groove on at least one of its two longitudinal edges that are provided with said fixing means, said groove serving to receive a filler plate.

5. A goods-handling door according to claim 1, wherein each spacer includes at least one longitudinal groove disposed in the plane of the panel and serving to receive a filler plate for said panel.

* * * * *

UNITED STATES PATENT AND TRADEMARK OFFICE

CERTIFICATE OF CORRECTION

PATENT NO. : 5,163.493

DATED : November 17, 1992

INVENTOR(S) : Bernard Kraeutler

It is certified that error appears in the above-indentified patent and that said Letters Patent is hereby corrected as shown below:

Claim 1, Column 5, line 15, between the words "identical" and "ends" should be inserted —,—, so as to read: ". . .being identical, ends of . . . ". also, Claim 1, Column 5, line 11, the word "for" should be deleted.

Signed and Sealed this

Twenty-third Day of November, 1993

*Attest:*

Bruce Lehman

BRUCE LEHMAN

*Attesting Officer*

*Commissioner of Patents and Trademarks*